United States Patent [19]

Katoh et al.

[11] Patent Number: 4,922,301

[45] Date of Patent: May 1, 1990

[54] ROTARY MULTICOLOR DEVELOPING APPARATUS

[75] Inventors: Shunji Katoh, Sagamihara; Noriyuki Kimura, Kawasaki; Yoshihiro Sakai, Kawasaki; Sigekazu Enoki, Kawasaki, all of Japan

[73] Assignee: Ricoh Company, Ltd., Tokyo, Japan

[21] Appl. No.: 300,247

[22] Filed: Jan. 23, 1989

Related U.S. Application Data

[63] Continuation of Ser. No. 39,741, Apr. 20, 1987, abandoned.

[30] Foreign Application Priority Data

| | | | |
|---|---|---|---|
| Apr. 24, 1986 | [JP] | Japan | 61-95771 |
| May 15, 1986 | [JP] | Japan | 61-111170 |
| May 15, 1986 | [JP] | Japan | 61-111171 |
| Jun. 13, 1986 | [JP] | Japan | 61-137730 |
| Jul. 10, 1986 | [JP] | Japan | 61-106193[U] |
| Oct. 6, 1986 | [JP] | Japan | 61-153608[U] |
| Oct. 20, 1986 | [JP] | Japan | 61-249301[U] |

[51] Int. Cl.[5] ..... G03G 15/09

[52] U.S. Cl. ..... 355/251; 355/326

[58] Field of Search ..... 355/3 DD, 4, 245, 251, 355/253, 326, 327; 118/645, 657, 658; 222/DIG. 1

[56] References Cited

U.S. PATENT DOCUMENTS

| | | | |
|---|---|---|---|
| 3,987,756 | 10/1976 | Katayamo et al. | 355/4 X |
| 4,351,604 | 9/1982 | Karasawa et al. | 355/4 |
| 4,593,991 | 6/1986 | Aoki et al. | 355/4 X |
| 4,622,916 | 11/1986 | Tanaka et al. | 118/645 X |
| 4,652,113 | 3/1987 | Watanabe | 355/4 X |
| 4,697,915 | 10/1987 | Hayashi et al. | 355/4 X |
| 4,707,108 | 11/1987 | Ohno | 355/4 |

*Primary Examiner*—Fred L. Braun

*Attorney, Agent, or Firm*—Oblon, Spivak, McClelland, Maier & Neustadt

[57] ABSTRACT

A rotary multicolor developing apparatus having a plurality of developing chambers defined in a rotatable developing drum, which neighbors and faces a photoconductive drum, and developing units each being disposed in a respective one of the developing chambers to supply toner of a particular color; the developing units being sequentially transported in a rotational motion to a predetermined developing region so that the toner is transferred from each developing unit to an electrostatic latent image provided on the photoconductive drum, thereby developing the latent image. In each developing unit, there are provided a magnetic brush which is sequentially transported between a toner supply region, the developing region, and a toner recovery region, a toner supply roller for transporting toner which is charged in the toner supply region to the magnetic brush, and a toner recovery roller for collecting in the toner recovery region the toner which remains on the magnetic brush after development. A toner supply drum adapted for the supply of a supplementary amount of toner is provided coaxially with the developing drum. The interior of the toner supply drum is partitioned into a plurality of toner chambers each corresponding to a respective one of the developing chambers of the developing drum, toner conveyors connecting each of the toner chambers to its associated developing chamber.

17 Claims, 10 Drawing Sheets

ROTARY MULTICOLOR DEVELOPING APPARATUS

This application is a continuation of application Ser. No. 039,741, filed on April 20, 1987, now abandoned.

FIELD OF THE INVENTION

The present invention relates to a developing apparatus and, more particularly, to a rotary multicolor developing apparatus having a plurality of developing units which are transported to a prescribed developing position one after another in a rotational motion. The developing apparatus to which the present invention pertains has application to a color electrophotographic copier and other various kinds of image forming instruments.

BACKGROUND OF THE INVENTION

In a color electrophotographic copier, for example, an image recorded in a document is separated into three different colors (i.e. red, green, and blue) and, then, light images each being associated with a respective one of the colors are individually developed by cyan, magenta, and yellow toner, which are complementary to those colors, or black toner. Such development, therefore, needs a plurality of developing units. However, constructing the developing units independently of each other and arranging them around an electrostatic latent image carrier would prohibitively increase the overall dimensions of the copier.

In the light of the above, there has been proposed a rotary multicolor developing apparatus which develops an electrostatic latent image by sequentially applying toner of different colors to the latent image. In this type of developing apparatus, a drum is rotatably disposed closely to a latent image carrier, and the interior of the rotatable drum is partitioned to define a plurality of circumferentially adjoining compartments, or developing chambers. Each of the developing chambers is provided with an opening for development, and developing means to constitute a developing unit for a particular color. Such developing units are sequentially transported in a rotational motion to a prescribed position close to a latent image carrier, (i.e., a developing position) so that toner of different colors are applied from the respective developing units to a latent image on the latent image carrier so as to develop it in multiple colors.

However, a prior art developing apparatus of the type described is operable with a so-called one-component developer only and not with a two-component developer which is capable of producing images with high quality and stability. Specifically, a developing apparatus of the kind using a two-component developer has to be constructed to sufficiently agitate and mix the developer in order to maintain toner density uniform and to promote good toner charging. This requisite cannot be met unless the developing units are furnished with various kinds of agitating mechanisms as well as substantial spaces for defining agitation paths, independently of each other. This renders each of the developing units prohibitively bulky, and applying such bulky developing units to a rotary developing apparatus is impracticable. If not impracticable, such would not make any significant contribution to the miniaturization of a developing apparatus in relation to the rotary construction.

In a rotary multicolor developing apparatus, the above-stated developing operation is usually effected with one of the developing units located in the predetermined developing position. Another problem with this type of prior art developing apparatus is that it is extremely difficult for each developing unit to be located in the developing position with accuracy. The resultant inaccurate distance between the latent image carrier and a developer carrier of the developing unit, (i.e., a gap for development) affects the quality of image reproduction to a critical degree.

In a rotary multicolor developing apparatus of the kind described, while one developing unit is brought to the developing position, a drive input portion of a developer carrier which is included in that developing unit is brought into connection with a drive output portion of a drive system that is mounted on the machine body, thereby transmitting a drive force for allowing the developer carrier to perform a predetermined motion for toner supply. In this regard, the prior art developing apparatus suffers from a drawback that the drive input and output portions (e.g., gears) cannot be smoothly brought into mesh with each other and generate impacts quite often. This stems from the fact that the drive output portion of the drive system (i.e., an output gear) is connected to a drive source at all times and, therefore, is provided with little freedom. The impacts frequently result in damage to various kinds of parts, generation of noise, and incomplete drive.

Still another problem with a rotary multicolor developing apparatus is that toner is often allowed to leak or scatter from both end portions of the opening for development, which do not contribute to development. The leaked or scattered part of toner deposited on optical parts critically impairs the optical characteristics of those parts, thereby deteriorating the quality of image reproduction. Deposition of such toner on electrical parts short-circuits them, resulting in malfunctions. Further, deposition of such toner on mechanical slidable parts accelerates the wear of those parts, to shortening their service life. Moreover, in the case of color development, the leaked or scattered part of one toner would be mixed with those of others, preventing different colors from being reproduced regularly.

In a prior art rotary multicolor developing apparatus, it has been customary to arrange, for example, a yellow developing unit, a magenta developing unit, a cyan developing unit, and a black developing unit in this order within and along the periphery of a rotary drum, so that toner of different colors may be applied to a latent image in the order of transparency, the lowest one first. In such a construction, when an image consisting of black characters and magenta (red) characters is to be recorded (as is desired most frequently), what is required is developing a latent image in black by the black developing unit, then skipping the cyan developing unit, and then transporting the magenta developing unit to a prescribed developing position. To implement ordinary black-and-white copying, which may be selected thereafter, the yellow developing unit has to be skipped after the completion of the development in magenta, followed by development in black. Such a sequence of recording steps consumes a considerable period of time. It is to be noted that a copy with black and magenta characters mixed together is produced by laying a black character document on a glass platen and, then, replacing it with a magenta character document.

Another prior art developing apparatus which belongs to a familiy of rotary multicolor developing apparatuses is constructed and arranged to inhibit a person from changing the order of arrangement of developing units (i.e., a yellow, a magenta, and a cyan developing unit); should a person try to relocate the cyan unit next to the yellow unit, the two units would interfere with each other to prevent such relocation. This means that the developing units are arranged in a fixed and unchangeable order.

A prior art rotary multicolor developing apparatus does not have a capability of supplying toner when toner in any of developing units becomes short (i.e., it is simply discarded once toner in any of the developing units is used up). This is undersirable from an economic viewpoint, because toner is not always consumed evenly in all the developing units. While one approach which may easily occur for the supply of toner is delivering toner of different colors to the respective developing units via a common toner delivery path, that approach would give rise to various secondary problems, such as mixing of toner of different colors and scattering of toner during delivery.

A rotary multicolor developing apparatus, as a matter of course, has a monocolor developing function for developing an image whose major part is occupied by black, red, blue, and other monochromatic lines, as is often the case with business copies, in addition to a full-color developing function adapted to develop a color photographic image and others. In a color electrophotographic copier with such a developing apparatus, there are selected latent those image developing conditions which are desirable in tone reproducibility so as to enhance the color balance of reproduced images. Major ones of such conditions may be the use of an electrically conductive carrier which exerts an insignificant edge effect, and the accommodation of great amounts of developers. A so conditioned color electrophotographic copier is capable of coping with considerable consumption of toner, which is inherent in color development, and enhancing reproducibility of photographic images.

Nevertheless, this type of prior art color electrophotographic copier is disadvantageous in that, since full-color development and monocolor development share the same developing conditions, designing those conditions with importance placed on color balance for full-color development would cause a reproduced image provided by monocolor development to appear excessively low in contrast, while designing them with importance placed on image quality attainable with monocolor development would render a reproduced image provided by full-color development excessively contrasty. One implementation which may be contemplated to solve such a problem is mounting a developing unit exclusive for monocolor (e.g. black-and-white) copying in a prior art color electrophotographic copier. This kind of scheme is not fully acceptable, however, because the extra developing unit limits the freedom of design of the other developing units, thereby decreasing their ability.

OBJECTS OF THE INVENTION

It is therefore an object of the present invention to provide a rotary multicolor developing apparatus which is operable with a two-component developer and, yet, miniature and stable in image quality.

It is another object of the present invention to provide a rotary multicolor developing apparatus in which a rotary drum is constantly positioned with accuracy at a predetermined developing position to stabilize image quality.

It is another object of the present invention to provide a rotary multicolor developing apparatus whose developing units can be smoothly connected to a drive system of an instrument in which the apparatus is installed.

It is another object of the present invention to provide a rotary multicolor developing apparatus which prevents toner from leaking and scattering positively with a simple structure.

It is another object of the present invention to provide a rotary mutlicolor developing apparatus in which a developing unit positioned next to a black developing unit serves as a magenta developing unit, which is of frequent use, thereby shortening the period of time necessary for an image of mixed colors to be recorded, as is often desired.

It is another object of the present invention to provide a toner supply device for use with a rotary multicolor developing apparatus which is capable of supplying toner without causing toner to be mixed or scattered around.

It is another object of the present invention to set up optimum developing conditions for both full-color development and monocolor development without resorting to complicated operations and structural changes.

SUMMARY OF THE INVENTION

A rotary multicolor developing apparatus in accordance with the present invention is of the type comprising a rotatable developing drum with developing units which is disposed near and to face a latent image carrier for carrying an electrostatic latent image therewith, the developing drum being indexed about a shaft thereof by each predetermined angle so that the latent image is developed in a predetermined region by toner of different colors which are fed from the developing units of the developing drum. The developing apparatus comprises partition members disposed in the developing drum to define developing chambers each storing the toner of a respective one of the colors. Each of the developing chambers extends radially from the shaft of the developing drum, has the same circumferential dimension as the others and extends along the shaft of the developing drum. Each of the developing units is disposed in a respective one of the developing chambers for developing the latent image with the toner. The developing units each comprises developing brush means for forming a magnetic brush which is sequentially transported between a toner supply region the developing region, and a toner recovery region and, in the developing region, makes contact with the latent image, toner supply means for conveying the toner which is charged in the toner supply region to the magnetic brush of the developing brush means, and toner recovery means for recovering in the toner recovery region the toner which is remaining on the magnetic brush after development.

A toner supply device in accordance with the present invention is applicable to a rotary multicolor developing apparatus which sequentially develops an electrostatic latent image with toner of different colors in a predetermined developing region and comprise a developing drum located near and to face a latent image carrier for carrying the latent image, a plurality of developing chambers defined in the developing drum, and developing units each being disposed in a respective one of the developing chambers for developing the latent image with toner of any of the colors. The toner supply device is characterized by comprising toner supply drum arranged and supported coaxially with the developing drum and storing supplementary toner of the different colors, a plurality of toner chambers defined by partitioning interior of the toner supply drum in a circumferential direction and each corresponding to a respective one of the developing chambers, and toner conveyor means each connecting a respective one of the toner chambers and a respective one of the developing chambers to supply the supplementary toner from the toner chamber to the developing chamber.

The above and other objects, features, and advantages of the present invention will become more apparent from the following detailed description taken with the accompanying drawings.

DESCRIPTION OF THE PREFERRED EMBODIMENTS

The present invention is based on the specific arrangement of the developing apparatus disclosed in U.S. Ser. No. 061,739, filed February 20, 1987 claiming the benefit of the priorities of Japanese Application No. 61-35544/1986 et al filed by Ricoh Company, Ltd. The developing apparatus proposed in that prior application has a so-called hybrid structure consisting of a cylindrical sleeve and magnet assembly, a toner recovery roller, a toner supply roller, a toner scraper blade, a toner layer limiting blade, a toner hopper, and others. The present invention contemplates to apply such a hybrid structure to a rotary multicolor developing apparatus.

Figure 1:
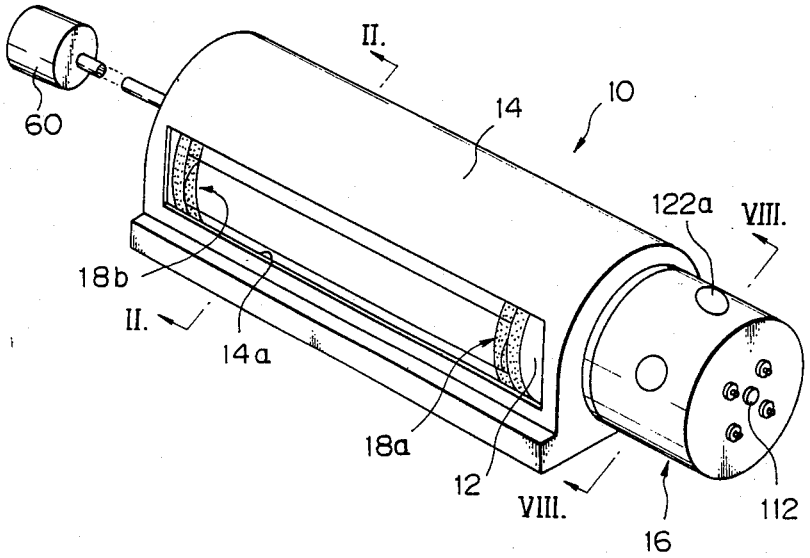
FIG. 1 is a perspective view of a rotary multicolor developing apparatus embodying the present invention.

Referring to FIG. 1 of the drawings, a rotary multicolor developing apparatus embodying the present invention is shown and generally designated by the reference numeral 10. As shown, the apparatus 10 includes a developing drum, or rotatable casing, 12 which is an essential element of the apparatus 10, and a housing 14 in which the drum 12 is rotatably accommodated.

The housing 14 is provided with a generally rectangular elongate window 14*a* and is positioned such that the window 14*a* adjoins a photoconductive drum or like latent image carrier, which will be described. The elongate window 14*a* extends in the axial direction of the photoconductive drum and is in alignment with a prescribed developing position on the periphery of the photoconductive drum. A part of the drum 12 shows itself through the window 14*a*. Specifically, the interior of the drum 12 is so partitioned as to define a plurality of developing chambers each accommodating a developing roller therein; as the drum 12 is rotated, the rollers (each of which is covered with toner of any color) are sequentially brought to the window 14*a* to develop a latent image which is electrostatically formed on the photoconductive drum.

A toner supply drum 16 adapted to supply toner of different colors is disposed at one side of the housing 14 and coaxially with the developing drum 12. A plurality of toner chambers are defined in the toner supply drum 16 in one-to-one correspondence with the developing chambers of the drum 12. The toner chambers and the developing chambers are interconnected by toner transporting means.

The developing drum 12 is provided at both ends thereof with sealing strips 18*a* and 18*b* which are made of an elastic material such as a sponge-like foamed material and which are adapted to prevent toner particles from leaking and scattering. Each of the sealing strips 18*a* and 18*b* covers the entire circumference of one end of the drum 12 and remains in contact with the inner periphery of the housing 14. That part of each sealing strip 18*a* or 18*b* which is exposed to the outside makes contact with the photoconductive drum. Teflon tapes or like film members having a relatively small coefficient of friction are provided on the surfaces of those contacting portions of the strips 18*a* and 18*b* in order to insure smooth rotation of the drum 12. Because the strips 18*a* and 18*b* are provided on the entire circumference of the drum 12, they are protected against separation and other occurrences which would otherwise be caused by the rotation of the drum 12 and which would otherwise invite scattering of toner particles.

Figure 2:
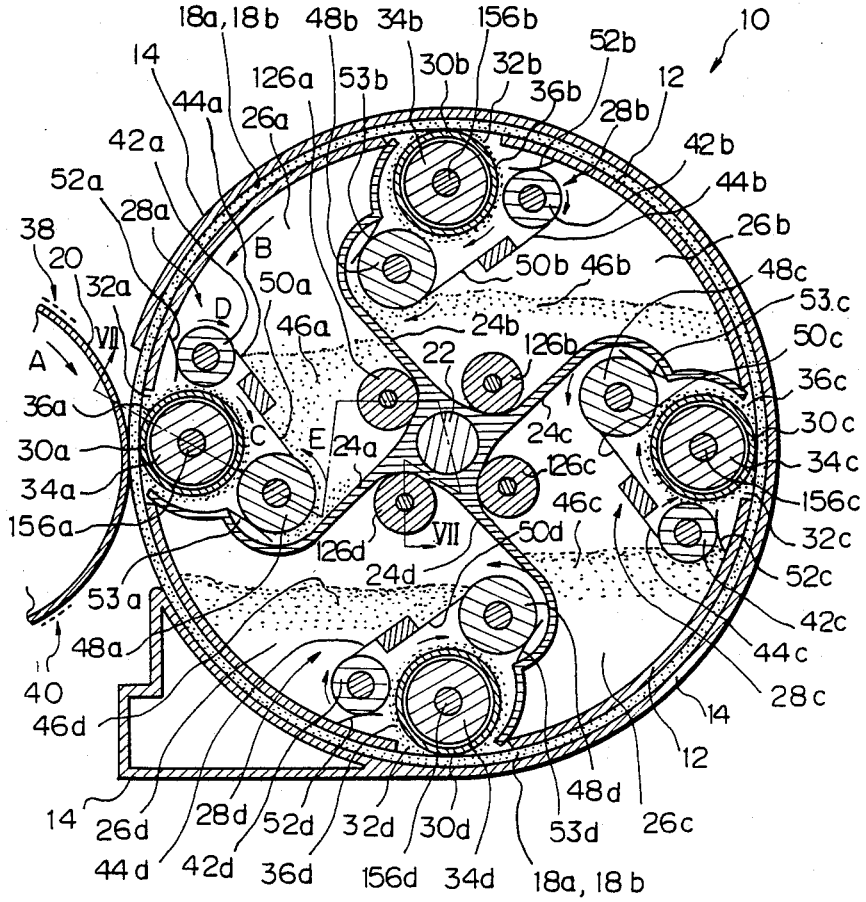
FIG. 2 is a section along line II—II of FIG. 1.

As shown in FIG. 2, the developing apparatus 10 is located in the vicinity of the photoconductive drum, 20, which is driven to rotate in a direction indicated by an arrow A by a drive mechanism, not shown. The hollow cylindrical developing drum, or casing, 12 is rotatably mounted on a shaft 22 and driven in a direction indicated by an arrow B. Four partitions 24*a*, 24*b*, 24*c* and 24*d* extend radially from the shaft 22 to define four adjoining compartments, or developing chambers, 26*a*, 26*b*, 26*c* and 26*d* which have the same dimension in the circumferential direction of the drum 12. The chambers 26*a* to 26*d* each extends in the axial direction of the drum 12. Developing units 28*a*, 28*b*, 28*c* and 28*d* each storing a developer of any color are accommodated in the chambers 26*a*, 26*b*, 26*c* and 26*d*, respectively.

The developing units 28*a* to 28*d* include, respectively, cylindrical sleeves 30*a*, 30*b*, 30*c* and 30*d* which are made of aluminum or like nonmagnetic material. The sleeves 30*a* to 30*d* are so positioned as to partly show themselves through openings 32*a*, 32*b*, 32*c* and 32*d*, respectively, which are formed through the developing drum 12. Magnets 34*a*, 34*b*, 34*c* and 34*d* each having a plurality of different magnetic poles arranged alternately with each other are respectively disposed in the sleeves 30*a* to 30*d* spaced from the inner periphery of the latter by a predetermined distance. Due to the magnetic forces of the magnets 34*a* to 34*d*, magnetic brush layers, or magnetic brushes, 36*a*, 36*b*, 36*c* and 36*d* are formed on the surfaces of the sleeves 30*a* to 30*d*, respectively. Each of the magnetic brushes 36*a* to 36*d* is moved as indicated by an arrow C as at least one of its associated sleeve 30*a*, 30*b*, 30*c* or 30*d* and magnet 34*a*, 34*b*, 34*c* or 34*d* is rotated by a drive system, which will be described.

Bias voltages of the same polarity are applied for development from a power source circuit, not shown, to the sleeves 30*a* to 30*d* and the photoconductive drum 20. The magnetic brushes 36*a* to 36*d* on the sleeves 30*a* to 30*d* being rotated are sequentially brought into contact with the photoconductive drum 20 on which a latent image 38 is formed electrostatically, thereby developing the latent image 38 with the toner to produce a visible image 40.

In this particular embodiment, all the sleeves 30*a* to 30*d* are provided with an outside diameter of 25 millimeters, while the magnets 34*a* to 34*d* are capable of producing magnetic forces on the outer circumferential surfaces of the sleeves 30*a* to 30*d* at a magnetic flux density of 800 gausses. This allows the magnetic brushes 36*a* to 36*d* to have a height ranging from 0.3 to 5 millimeters, preferably 0.7 to 2 millimeters.

The bias voltages previously stated are applied to prevent unwanted toner deposits on the background of a copy and also to adjust the density of an image on the copy. Where the potential of the latent image is −800 volts and normal image development is desired, it is preferable that a developing bias voltage in the range of from 0 to −500 volts be applied. For reversal image development, negatively chargeable toner should be employed, and the developing bias voltage should range from −200 to −800 volts. The final developing bias voltage is determined in view of the density of a document to be copied or as the user wishes.

Toner recovery rollers 42*a*, 42*b*, 42*c* and 42*d* are respectively held in contact with the magnetic brushes 36*a* to 36*d* so as to recover residual toner from the magnetic brushes 36*a* to 36*d* after the image on the photoconductive drum 20 has been developed. Scraper blades 44*a*, 44*b*, 44*c* and 44*d* are respectively maintained in pressing contact with the toner recovery rollers 42*a* to 42*d* to scrape the recovered toner particles off the rollers 42*a* to 42*d*, the toner particles scraped off being delivered back into a corresponding toner hopper 46*a*, 46*b*, 46*c* and 46*d*, respectively.

A predetermined bias voltage for the recovery of toner is applied from a power source circuit, not shown, to each of the toner recovery rollers 42*a* to 42*d*. Adapted to collect residual toner from the magnetic brushes 36*a* to 36*d*, the bias voltage stated above is of the same level as the developing potential (i.e., of such a level that it would be able to develop an entire latent image on any of the toner recovery rollers 42*a* to 42*d* if the rollers 42*a* to 42*d* were latent image carriers). For example, if the latent image potential is −800 volts and the developing bias voltage is −200 volts, then the toner recovering bias voltage may be about −600 volts.

It is not necessary to recover the entire toner contained in the magnetic brushes 36*a* to 36*d*, but it suffices to selectively recover toner in the vicinity of the surfaces of the magnetic brushes 36*a* to 36*d*. The toner recovery is effected at least to remove toner density irregularities on the magnetic brushes 36*a* to 36*d*. For example, different toner densities on the magnetic brushes 36*a* to 36*d* resulting from different toner consumption rates in black, halftone and background areas are equalized by the toner recovery rollers 42*a* to 42*d*.

Generally, toner of a two-component developer is applied in an amount ranging from 0.8 to 1.0 milligrams per unit area ($cm^2$). Toner is supplied to the latent image 38 while the photoconductive drum 20 and the magnetic brushes 36*a* to 36*d* are relatively rotating at a speed ratio of about 1:3. Therefore, the magnetic brushes 36*a* to 36*d* are only capable of supplying toner in the range of 0.27 to 0.33 milligrams per unit area each. By recovering remaining toner at a rate exceeding the toner supplying capability of any of the magnetic brushes 36*a* to 36*d*, the toner densities on the magnetic brush can be uniformized, thereby cancelling out adverse effects given by the image development.

More specifically, a general two-component developer has a bulk specific gravity of 2 and a toner density of 3%. With such a two-component developer used, the weight of a magnetic brush having a height of 1 millimeter is 0.2 grams per unit area ($cm^2$). Since the weight of toner contained in that unit magnetic brush volume is 6 milligrams, the toner which actually contributes to image development is only 5% of the magnetic brush. Stated another way, it sufficies to recover toner corresponding only to that 5%. Differences in toner consumption by the magnetic brush can effectively be eliminated inasmuch as toner at a density of about 0.3 milligrams per square centimeter is localized in the vicinity of the surface of the magnetic brush by a toner supply roller.

The toner recovery rollers 42*a* to 42*d* are individually driven to rotate in the direction of an arrow D for preventing recovered toner from being applied again to their associated magnetic brushes 36*a* to 36*d*.

Toner supply rollers 48*a* to 48*d* are disposed downstream of the toner recovery rollers 42*a* to 42*d* and in contact with the magnetic brushes 36*a* to 36*d*, respectively. Each of the toner supply rollers 48*a* to 48*d* is rotated in the direction of an arrow E by a drive mechanism, not shown.

Toner layer limiting blades 50*a*, 50*b*, 50*c* and 50*d* are held in pressing contact with the toner supply rollers 48*a* to 48*d*, respectively. The blades 50*a* to 50*d* are adapted to apply uniform thin layers of toner to their associated toner supply rollers 48*a* to 48*d* while at the same time triboelectrically charging the toner.

The toner scraper blades 44*a* to 44*d* and toner layer limiting blades 50*a* to 50*d* cooperate, respectively, with the previously stated partitions 24*a* to 24*d* to define toner hoppers 46*a*, 46*b*, 46*c* and 46*d* each having a predetermined space. Toner of any color selected is stored in a respective one of the toner hoppers 46*a* to 46*d*. The toner supply rollers 48*a* to 48*d* are arranged such that substantially their lower half is buried in the toner when brought to the developing position (i.e. the position of the roller 48*a* as shown in FIG. 2). As any of the toner supply rollers 48*a* to 48*d* is rotated, toner stored in its associated toner hopper 46*a*, 46*b*, 46*c* or 46*d* is supplied to the corresponding magnetic brush 36*a*, 36*b*, 36*c* or 36*d* past the toner supply roller. The toner supply rollers 48*a* to 48*d* are also capable of limiting the heights of brush fibers of the magnetic brushes 36*a* to 36*d* to a uniform level for eliminating image density irregularities.

Other blades, rollers or like limiting members, not shown, may also be disposed closely to the respective sleeves 30*a* to 30*d* between those positions where they make contact with the toner supply rollers 48*a* to 48*d* and the developing area, so that the heights of the brush fibers of the magnetic brushes 36*a* to 36*d* may be uniformized more positively.

To each of the toner supply rollers 48*a* to 48*d*, there is supplied a toner supplying bias voltage by a power supply circuit, not shown, for efficiently transferring the toner to the associated one of the magnetic brushes 36*a* to 36*d*. The toner supplying bias voltage is of the same polarity as that of the charged toner and ranges from about 0 to 600 volts. In order that the toner may reliably be retained on any of the toner supply rollers 48*a* to 48*d*, a toner supply bias voltage of the polarity opposite to that of the charged toner is supplied. In such a case, it is better to make the toner supply bias voltage lower than the image developing bias voltage.

Assuming that the voltages to be impressed on the sleeves 30*a* to 30*d*, the recovery rollers 42*a* to 42*d* and the supply rollers 48*a* to 48*d* are indicated respectively by $V_B$, $V_R$ and $V_D$, it is preferable that the following relationship:

$$|V_B| \gtrsim |V_D|$$

be met for well-balanced toner supply to and recovery from the sleeves. Moreover, the following relationship should preferably be met:

$$|V_B| - |V_D| \gtrsim |V_R| - |V_B|$$

for more uniform toner density on the sleeves.

Further, scrapers 52*a*, 52*b*, 52*c* and 52*d* extend from the inner periphery of the developing drum 12 to be in pressing contact with the toner recovery rollers 42*a* to 42*d*, respectively. Similarly, scrapers 53*a*, 53*b*, 53*c*, and 53*d* extend from the inner periphery of the developing drum 12 to be in pressing contact with and the toner supply rollers 48*a* to 48*d*, respectively. The scrapers 52*a* to 52*d* and 53*a* to 53*d* serve to prevent the toner of the respective colors from leaking to the outside.

The power source circuit adapted to apply the developing bias voltage is provided with an encoder for turning an output voltage of the circuit into a signal by dividing the former into four bits. A signal representative of the output developing bias voltage is applied to a control circuit, not shown. The control circuit is in turn provided with an arithmetic circuit for computing a bias voltage for adequate toner supply which corresponds to the developing bias voltage. The output signal of such a control device is fed to the power source circuit which is adapted to apply the toner supply bias voltage, whereby the bias voltage for toner supply is determined. For example, an arrangement is made such that the differential between the two different bias voltages remains constant.

The toner recovery rollers 42*a* to 42*d* and the toner supply rollers 48*a* to 48*d* may be made of metal, electrically conductive rubber or the like insofar as an electric bias can be applied between those rollers and the associated sleeves 30*a* to 30*b*. The rollers 42*a* to 42*d* and the rollers 48*a* to 48*d* are disposed in contact with the magnetic brushes 36*a* to 36*d* in a position ranging from 50% to 100% of the height of the magnetic brushes 36*a* to 36*d*, respectively. However, the rollers 42*a* to 42*d* and 48*a* to 48*d* may be disposed in a position exceeding 100% of the height of their associated magnetic brushes 36*a* to 36*d* provided that the absolute value of the air gap is 1 millimeter or smaller, with the addition of electric biasing means.

While the outside diameters of the rollers 42*a* to 42*d* and 48*a* and 48*d* may be selected as desired, they should be 80% or smaller of the outside diameter of the sleeves 30*a* to 30*d* or in the range of from 5 to 60 millimeters, preferably 8 to 40 millimeters.

Since the amount of toner supplied to each of the sleeves 30*a* to 30*d* is dependent also on the relative speed between the sleeves 30*a* to 30*d* and the toner supply rollers 48*a* to 48*d*, the amount of toner to be supplied may be controlled by varying the rotation speed of each of the toner supply rollers 48*a* to 48*d*. More specifically, the toner density may be detected by a known sensor, so that the rotational speed of any of the toner supply rollers can be controlled. Such a known sensor for detecting the toner density may be a means for detecting the reflected density of toner on each of the toner recovery rollers 42*a* to 42*d* and computing the toner density from the detected reflected toner density.

The toner layer limiting blades 50*a* to 50*d* may be disposed in pressing contact with the surfaces of their associated toner supply rollers 48*a* to 48*d* which are diametrically opposite to the illustrated surfaces, FIG. 2. In such a modification, the toner supply rollers 48*a* to 48*d* are rotated in the direction opposite to the direction of the arrow E.

Figure 3:
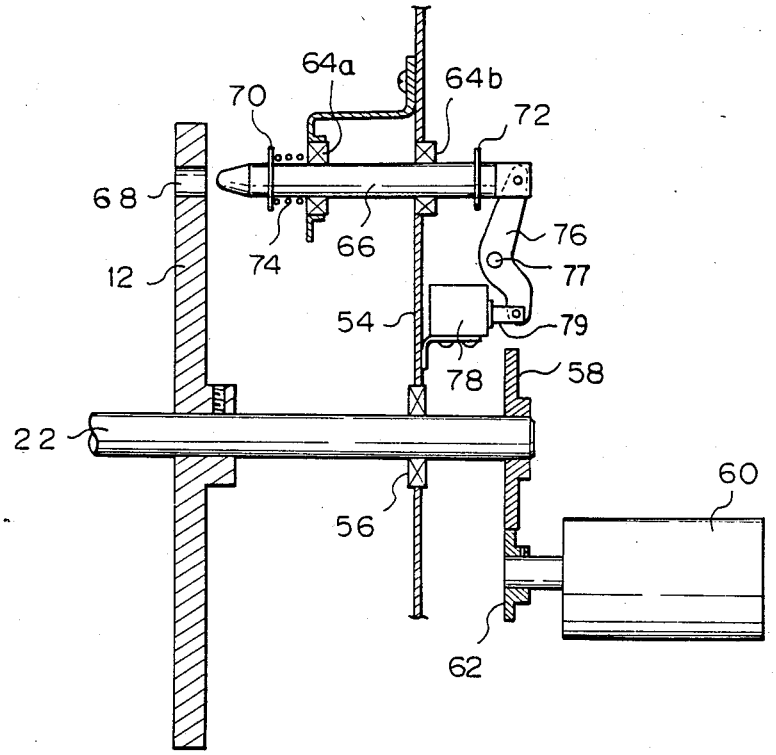
FIG. 3 is a vertical section of a positioning device which is included in the apparatus of FIG. 1.

Referring to FIG. 3, the shaft 22 on which the developing drum 12 is mounted is rotatably supported by a bearing 56, which is in turn mounted on a side panel 54 of, for example, a color electrophotographic copier. A driven gear 58 is rigidly mounted on an end portion of the shaft 22 and held in constant mesh with a drive gear 62 which is rigid on an output shaft of a stepping motor 60. A positioning rod 66 is supported by two thrust bearings 64*a* and 64*b*, which are provided on the side wall panel 54, in such a manner as to be movable toward and away from the developing drum 12. The tip of the positioning rod 66 close to the drum 12 is tapered to be mated with a positioning hole 68 which is formed in the drum 12.

Flanges 70 and 72 extend radially outwardly from both end portions of the positioning rod 66. A coil spring 74 is loaded between the front flange 70 and the thrust bearing 64*a*, which is located behind the flange 70. The coil spring 74 constantly biases the positioning rod 66 forward, i.e., toward the positioning hole 68. The rear flange 72 plays the role of a stop. Specifically, when the positioning rod 66 is thrust forward by a predetermined amount, the rear flange 72 is brought into contact with the thrust bearing 64*b* to prevent any further movement of the rod 66.

A drive arm 76 is pinned at one end to a rear end portion (right end portion in FIG. 3) of the positioning rod 66, rotatably mounted on a pin 77 connected to the machine body at its intermediate portion, and pinned to an output shaft of a solenoid 78 at the other end. When the solenoid 78 is energized, the positioning rod 66 is pulled out of the positioning hole 68 as shown in FIG. 3; when the solenoid 78 is deenergized, the positioning rod 66 is thrust toward the positioning hole 68 by the force of the coil spring 74. It is to be noted that four such positioning holes 68 are formed is the developing drum 12 in correspondence with predetermined target positions for development of the respective developing units 28*a* to 28*d*. In this construction, when the positioning rod 66 is mated with any of the positioning holes 68, any of the developing units 28*a* to 28*d* corresponding to that hole 68 is retained in the predetermined developing position.

While the solenoid 78 is deenergized to hold the positioning rod 66 out of the positioning holes 68, the developing drum 12 is free to rotate. Then, the drum 12 is driven in a rotational motion in the direction of the arrow B, FIG. 2. As soon as the desired developing unit (for example, the developing unit 28*a*reaches the developing position, the solenoid 78 is deenergized so that the positioning rod 66 is thrust into the positioning hole 68 by the coil spring 74 to position the drum 12. Consequently, the developing unit 28*a* is maintained in the predetermined target position for development.

Figure 4:
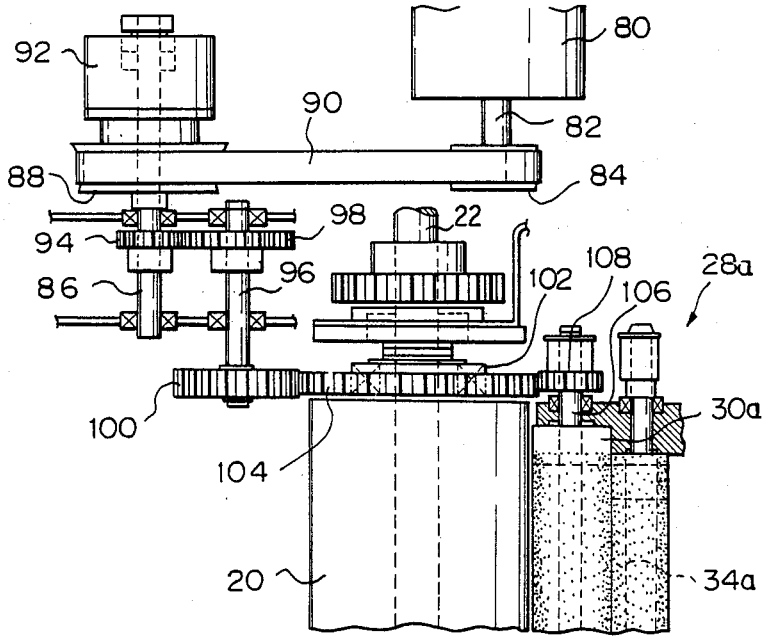
FIGS. 4 and 5 are views of a drive force transmission mechanism installed in the apparatus of FIG. 1.
Figure 5:
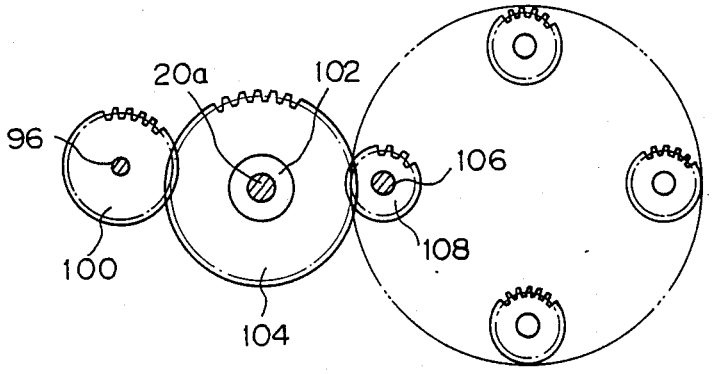

Hereinafter will be described a drive system associated with the sleeves 30*a* to 30*d* or with the magnets 34*a* to 34*d* with reference to FIGS. 4 and 5.

A drive pulley 84 is rigidly mounted on an output shaft 82 of a drive motor 80 while a driven pulley 88 is rotatably mounted on a first transmission shaft 86. A belt 90 is passed over the pulleys 84 and 88. A clutch 92 is mounted on the first transmission shaft 86 and close to the driven pulley 88 so as to selectively set up operative connection between the driven pulley 88 and the first transmission shaft 86. The clutch 92 may be implemented with a solenoid-operated clutch or the like. A gear 94 is also mounted on the first transmission shaft 86 and meshed with a gear 98, which is mounted on one end of a second transmission shaft 96. A gear 100 is mounted on the other end of the second transmission shaft 96. The gear 100 is held in mesh with a gear 104 which is rotatably supported by a bearing 102 on the shaft 22 of the photoconductive drum 20, the gear 104 thus serving as a drive output portion.

The sleeve 30*a* (the same applies to the other sleeves 30*b*, 30*c* and 30*d*) is mounted on a drive shaft 106. A gear 108 is mounted on the shaft 106 to serve as a drive output section. When the developing unit, for example 28*a*, is brought to the developing position as illustrated, the gear 108 is brought into mesh with the gear 104. When the unit 28*a* is moved away from the developing position, the gear 108 is released from the gear 104.

The clutch 92 is operated by a control unit, not shown. Specifically, when the developing unit 28*a* is held in the developing position, the clutch 92 is coupled to transmit the drive force to the gear, or drive output portion, 104. On the other hand, when the developing unit 28*a* is out of the developing position, the clutch 92 is uncoupled to free the gear 104.

Assume that the developing drum 12 is rotated as indicated by the arrow B to bring the developing unit 28*a* to the developing position. Then, the developing unit 28*a* is positioned by the positioning mechanism as described with reference to FIG. 3. At the same time, the gear 108 adapted to apply a drive force to the sleeve 30*a* or the magnet 34*a* of the developing unit 28*a* is moved into mesh with the gear 104. At the instant when the gears 104 and 108 are coupled, the clutch 92 has been uncoupled to maintain the gear 104 in a free state. Hence, the gear 104 is automatically synchronized to the gear 108 when meshed with the latter. Stated another way, the gears 104 and 108 are allowed to mesh with each other smoothly without any collision. Upon the meshing of the gears 104 and 108, either the sleeve 30*a* or the magnet 34*a* is driven to rotate to initiate a developing operation.

Specifically, the toner in the toner hopper 46*a* is triboelectrically charged by the rotation of the toner supply roller 48*a*, while at the same time the toner is supplied as a thin uniform layer to the magnetic brush 36*a* under a prescribed toner supply biasing voltage. Then, the magnetic brush 36*a* supplied with the toner is moved toward the photosensitive drum 20 for developing an electrostatic latent image 38 formed on the photoconductive drum 20. After the image has been developed, there are toner density irregularities left on the magnetic brush 36*a* which correspond to the image. The remaining toner on the magnetic brush 36*a* is transferred to and recovered by the toner recovery roller 42*a* under a prescribed electric toner recovery bias. The toner density irregularities on the magnetic brush 36*a* are thus eliminated, and the toner density on the magnetic brush 36*a* is uniformized. More specifically, the magnetic brush 36*a* after toner recovery contains a carrier only or has a uniform toner density distribution, and it is moved away from the toner recovery roller 42*a* toward the toner supply roller 48*a*. The toner supply bias voltage is controlled on the basis of the developing bias voltage (i.e., toner is supplied to the magnetic brush 36*a* by an amount which is consumed during the development). This balances the amount of toner supplied and the amount of toner consumed, eliminating excessive or short toner supply.

After the development by the developing unit 28*a* has been completed, the developing drum 12 is rotated again until the next developing unit 28*b* assumes the developing position through the same sequence of steps as previously described.

It is to be noted that the gear 104 on the drive output side may be arranged coaxially with the photoconductive drum 20, while at the same time the frictional resistance exerted by the bearing 102 to the rotation may be designed relatively strong. Such would allow the gear 104 in its free state to follow the rotation of the drum 20 and, thereby, would allow the synchronizing motion of the gear 104 to be completed beforehand and, consequently, would further promote smooth meshing of the gear 108 with the gear 104.

Figure 6:
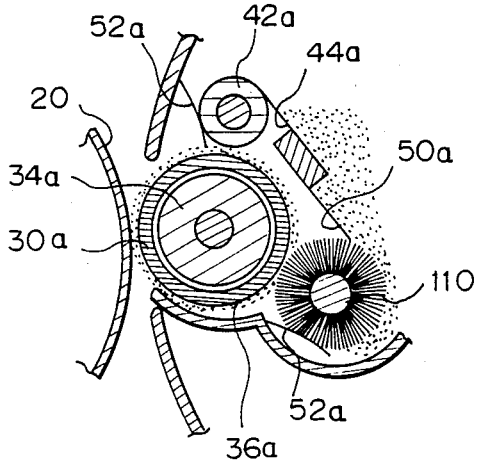
FIG. 6 is a fragmentary vertical section showing a modification to the embodiment of FIG. 1.

FIG. 6 shows a modification to the above construction in which a fur brush 110 is used to supply toner to the magnetic brush 36*a*. The fur brush 110 increases the amount of toner supplied, thereby enhancing rapid image processing, compared to the roller type scheme as prieviously shown and described.

In a prior art rotary multi-color developing apparatus, it has been customary to arrange independent developing units in a developing drum in a predetermined relationship. For example, assuming that a developing drum is rotatable counterclockwise, a yellow developing unit, a magenta developing unit, a cyan developing unit, and a black developing unit are arranged in this order, as shown in FIG. 2. That is, the developing units are rotated counterclockwise so that toner is supplied in order of transparency, the lowest one first. A problem with such a prior art rotary multi-color developing apparatus is that a recording with black characters and magenta (red) characters mixed together, which is desired most frequently, is unattainable unless development is made in black by the black developing unit and, then, the magenta developing unit is transported to the developing position skipping a cyan developing unit; for a black-and-white recording which may be desired thereafter, it is necessary to perform development in black, skipping the yellow developing unit, after the development in magenta. The result is a disproportionately time-consuming recording operation.

In the light of the above, the rotary multi-color developing apparatus described above is arranged such that the magenta developing unit, which is frequently used, neighbors the black developing unit. More specifically, assuming that the developing unit 28*a* shown in FIG. 2 is the magenta developing unit, the role of the black developing unit is assigned to the developing unit 28*b*. Here, the developing units 28*c* and 28*d* are assumed to be the cyan developing unit and the yellow developing unit, respectively. This kind of arrangement eliminates the need for skipping the cyan and yellow developing units and, therefore, shortens the recording time, compared to the prior art apparatus.

When the latent image 38 on the photoconductive drum 20 was developed using the developing apparatus 10 and putting all the developing units 28*a* to 28*d* under the same conditions, the toner of each color was found applied by an amount of 0.8 to 1.0 milligram per square centimeter. The resultant toner image 40 was fully acceptable as a monocolor copy (for business use) of each of magenta, cyan, and black (yellow was too pale to serve for monocolor copying), but it suffered from excessively high contrast due to the excessive amount of toner deposition when it came to a full-color copy consisting of yellow, magenta and cyan toner superposed one after another.

In an effort to solve the above problem, development was performed under the same conditions as described above except that the toner supply rollers of those developing units which stored yellow, magenta, and cyan toner were rotated at half the speed of the toner supply roller of a developing unit which stored toner of another color. Then, the amount of deposition of each of the yellow, magenta and cyan toner was found reduced to 0.4 to 0.5 milligrams per square centimeter; a full-color copy produced under such a condition had adequately low contrast and photographic reproducibility and, in addition, a monocolor copy was fully acceptable, too. This is accounted for by the fact that the amount of toner (black) other than those for full-color copying, which occupies a major part of images in the case of monocolor copying, is applied by the amount of 0.8 to 1.0 milligrams per square centimeter as before.

As described above, both a full-color copy and a monocolor copy can be provided with uniform contrast only if the toner supply rollers are rotated at different speeds depending upon the copy mode, i.e., if the developers (cyan, magenta, and yellow toner) stored in those developing units adapted for full-color development are supplied at a low rate than the developer (toner of a color other than those mentioned) stored in the developing unit which is adapted for monocolor development.

Some different approaches are available for setting up developing conditions as stated above. For example, the drive system assigned to the toner supply rollers of those developing units which store cyan, magenta, and yellow toner may be provided with specifications which are different from those of the drive system which is assigned to the toner supply roller of the other developing unit. Alternatively, the magnetic brushes for full-color copying may be moved on the associated sleeves at a different speed from the magnetic brush for monocolor copying.

Now, color development is generally applied to an image a major area of which is solid and, therefore, it consumes a substantial amount of toner. It follows that toner will soon become short if it is only the toner hopper which is constituted by the lower portion of each developing unit that is available for the storage of toner.

Another characteristic feature of the developing apparatus 10 in accordance with the present invention is a toner supply device as will be described.

Figure 7:
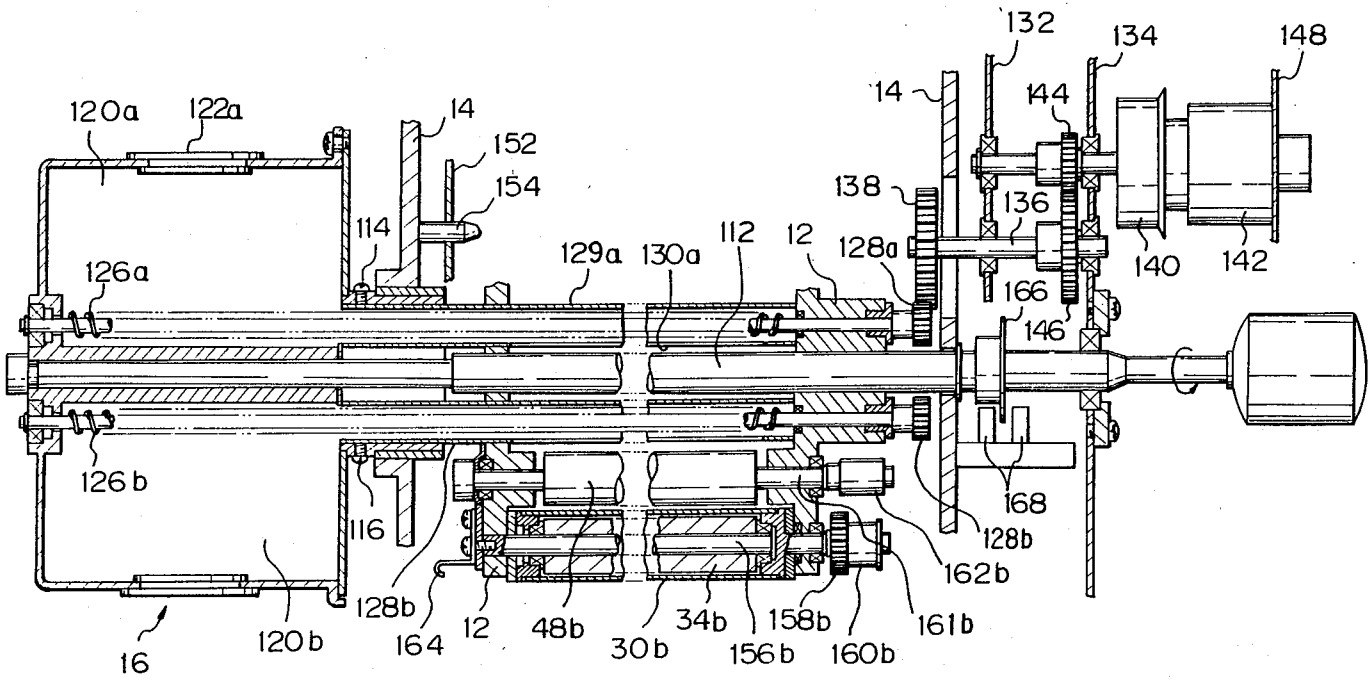
FIG. 7 is a section along line VII—VII of FIG. 2.
Figure 8:
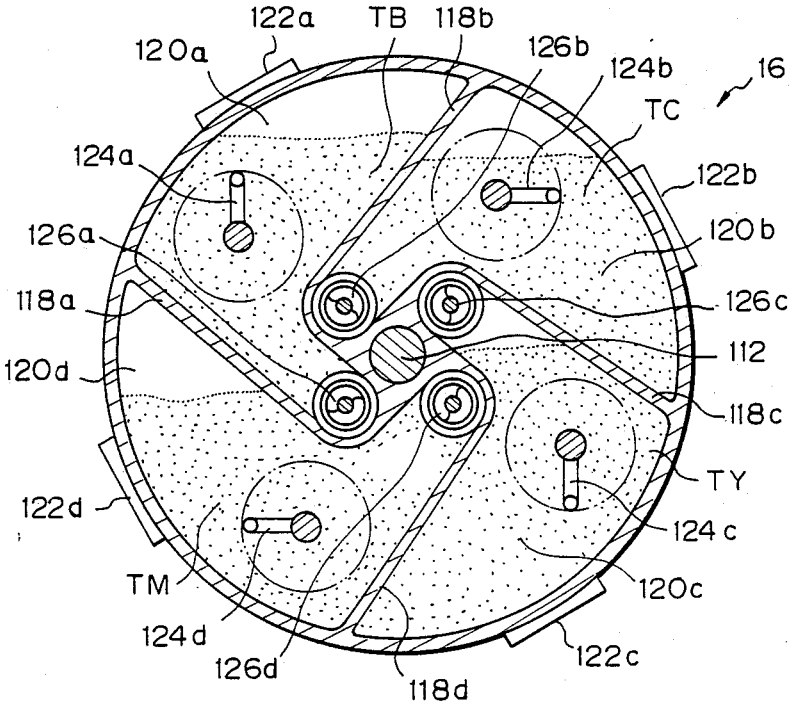
FIG. 8 is a section along line VIII—VIII of FIG. 1.

The toner supply device includes the toner supply drum 16 which stores toner of respective colors. As shown in FIGS. 1 and 7, the drum 16 is disposed outside of the housing 14 and mounted on and coaxially with a shaft 112 by screws 114 and 116 in a cantilevered manner. The diameter of the toner supply drum 16 is equal to or slightly greater than that of the developing drum 12. As shown in FIG. 8, radially extending partitions 118*a*, 118*b*, 118*c* and 118*d* divide the interior of the developing drum 12 into four compartments, or toner chambers, 120*a*, 120*b*, 120*c* and 120*d* which are equal in circumferential dimension. The toner chambers 120*a* to 120*d* are a black toner chamber, a cyan toner chamber, a yellow toner chamber, and a magenta toner chamber, respectively. That is, the toner chambers 120*a* to 120*d* store black toner TB, cyan toner TC, yellow toner TY, and magenta toner TM, respectively.

Since all the toner chambers 120*a* to 120*d* are identical in construction, the following description will concentrate on the black toner chamber 120*a* by way of example. A rubber cap 122*a* is removable to supply toner to the black toner chamber 120*a*. An agitator 124*a* is disposed in the toner chamber 120*a*. The toner chamber 120*a* is generally L-shaped in section. One end of a screw conveyor 126*a* is located in the base portion of the L-shaped toner chamber 120*a* which is close to the shaft 112. The screw conveyor 126*a* extends from the toner chamber 120*a* into the developing chamber 26*a* in parallel with the shaft 112. The shaft portion of the screw conveyor 126*a* extends throughout the housing 14 and is provided with a gear 128*a* at one end thereof, as shown in FIG. 7. As also shown in FIG. 7, that part of the screw conveyor 126*a* which extends between the right wall of the supply drum 16 and the left wall of the developing drum 12 is surrounded by a cylindrical conveyor case 129*a*. The conveyor case 129*a* is formed with an axially extending slot 130*a* in its area which faces the sleeve 30*a*.

A shaft 136 is journalled to side panels 132 and 134 of a copier or the like. A gear 138 is mounted on the shaft 136 and held in mesh with the gear 128*a*. Torque is transmitted from a pulley 140 to the gear 138 by way of a solenoid-operated clutch 142, a gear 144, and a gear 146. The clutch 142 is mounted on a side panel 148 of the instrument such as a copier. In this construction, as the screw conveyor 126*a* is rotated, it conveys the black toner TB from the toner chamber 120*a* toward the developing chamber 26*a* through the conveyor case 129*a* until the toner TB has been dropped through the slot 130*a* into the developing chamber 26*a*. It is to be noted that the right end portion of the screw conveyor 126*a* is threated in the opposite direction to the other portion so as to prevent the toner from gathering around the end of the conveyor case 129*a*.

As seen from the above description, the screw conveyor 126*a* is driven at the time when the black toner TB is deposited on the screw conveyor 126*a* inside the toner chamber 120*a*, as shown in FIG. 8, and the slot 130 is oriented downward inside the developing chamber 26*a*. Roughly described, the positional relationship between the toner chamber 120*a* and the developing chamber 26*a* is such that, when the former assumes an angular position with the screw conveyor 126*a* disposed below, the latter assumes an angular position with the screw conveyor 126*a* disposed above. This is intended to allow the toner to drop by gravity in the developing chamber 26*a* while the screw conveyor 126*a* in the toner chamber 120*a* is buried in the toner. Such an angular position is set up when, for example, the sleeve 30*b* is positioned to face the photoconductive drum 20. Hence, the black toner TB is supplied to the developing chamber 26*a* when the cyan toner TC is being applied for development.

Screw conveyors 126*b*, 126*c* and 126*d* and conveyor cases 129*b*, 129*c* and 129*d* are provided between the toner chambers 120*b*, 120*c* and 120*d* and their associated developing chambers 26*b*, 26*c* and 26*d*, respectively. Each of the screw conveyors 126*b* to 126*d* is arranged in the same manner as the screw conveyor 126*a*, so that toner supply is effected as the above-stated relationship between the toner chamber and the developing chamber is reached. Each of the screw conveyors 126*b* to 126*d* is driven when a gear 128*b* to 128*d* which is mounted on its shaft is brought into mesh with the previously mentioned gear 138. Specifically, while the gear 128*a* is shown in FIG. 7 as being meshed with the gear 138 to supply the black toner TB, a gear 128*b* mounted on the shaft of the screw conveyor 126*b* will be meshed with the gear 138 when the cyan toner TC is to be supplied. The solenoid-operated clutch 142 is adapted to determine the amount of rotation of the screw conveyor and, therefore, the amount of toner to be supplied on the basis of the amount of toner consumed by the last development.

In this manner, the toner supply drum 16 and the developing drum 12 are each rotated by each 90 degrees to develop a latent image with the toner of different colors while supplying the toner.

Figure 9:
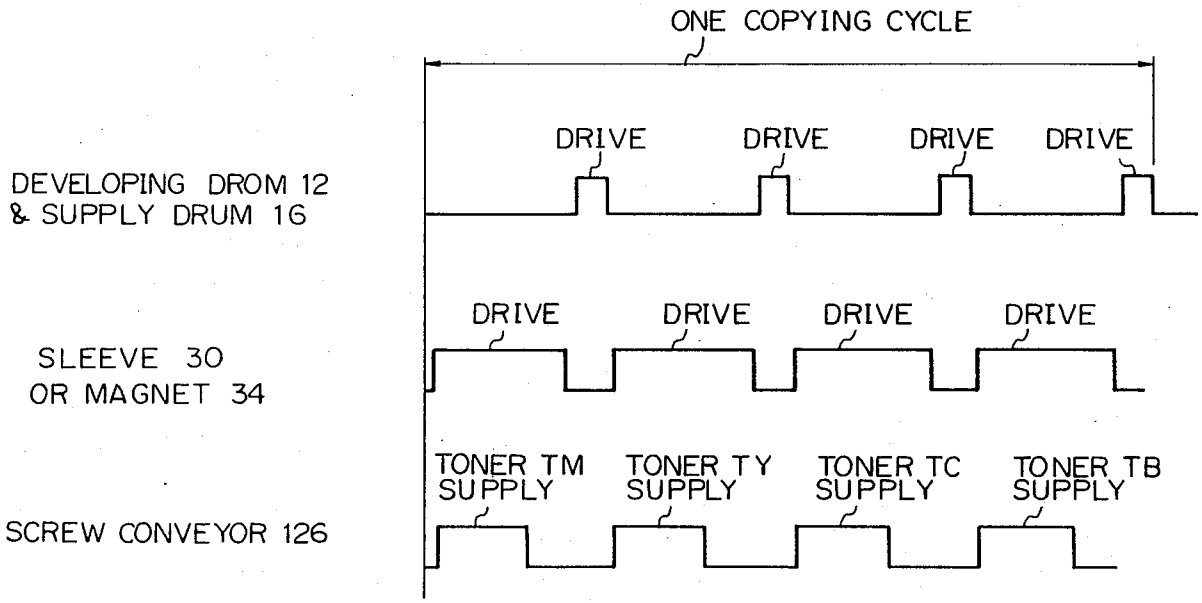
FIG. 9 is a chart representative of toner supply timing.

FIG. 9 shows the relationship between the drive timings of the developing drum and the toner supply drum and those of the sleeves or magnets and the screw conveyors. The sequence shown in FIG. 9 is such that, while development in a certain color is under way, the developing chamber which neighbors the developing chamber being used for the development is supplied with toner and, on completion of the development, the developing and toner supply drums are rotated. Toner of any color may be supplied to the supply drum 16 while the corresponding rubber cap 122*a* to 122*d* is in its upper position.

As described above, the supply drum 16 is partitioned to define discrete toner chambers, and screw conveyors each serving as toner conveying means are associated one-to-one with the toner chambers. Such allows toner to be supplied to each of developing chambers without being mixed the others each of developing chambers without being mixed with the others or being scattered around.

As shown in FIG. 7, the developing drum 12 is journalled to the housing 14 which is in turn positioned by a pin 154 relative to a side panel 152 of the machine. A gear 158*b* is mounted on a shaft 156*b*, which is adapted to drive the sleeve 30*b* and magnet 34*b*, and held in mesh with a drive gear which is mounted on the machine. A belt, not shown, is passed over a pulley 160*b* which is integral with the gear 158*b* and a pulley 162*b* which is mounted on a shaft 161*b* adapted to drive the toner supply roller 48*b*, whereby the toner supply roller 48*b* is driven in a rotational motion. The reference numeral 164 in FIG. 7 designates a metal piece for applying a bias voltage to the photoconductive drum 20 and the sleeve 30*b*. Further, where the motor 60 is not a stepping motor, a rotary encoder 166 and a photocoupler 168 are used to index the developing drum 12 to the prescribed developing position.

Hereinafter will be described some examples of a color electrophotographic copier and other color image forming instruments to which the present invention is applicable.

Figure 10:
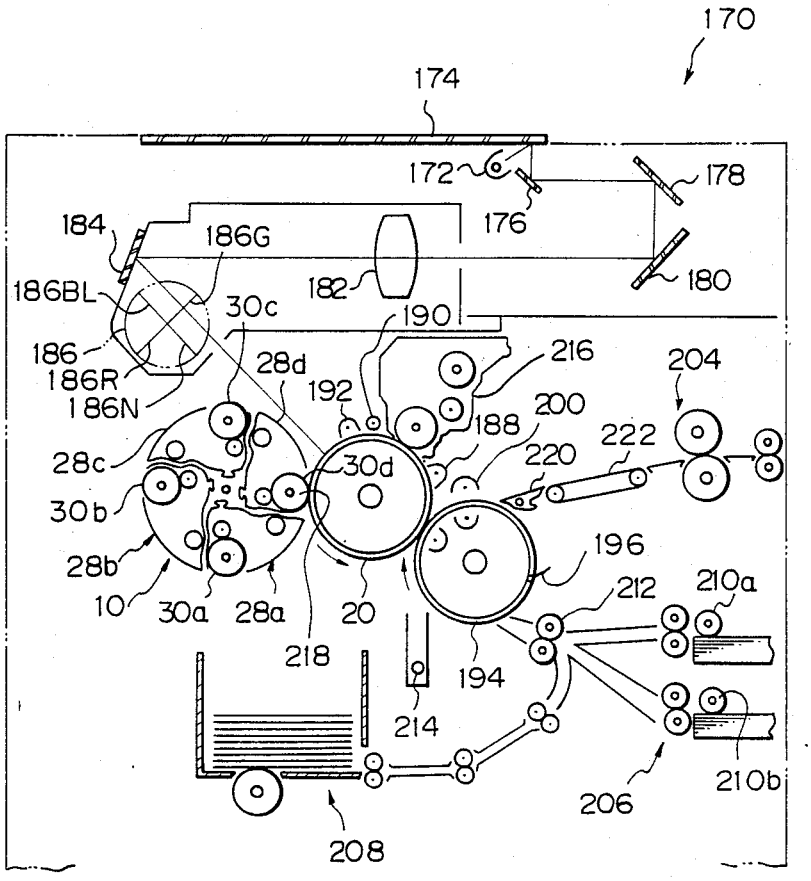
FIGS. 10 and 11 are vertical sections each showing a color electrophotographic copier to which the present invention is applied.

Referring to FIG. 10, there is shown an electrophotographic copier which incorporates the rotary multicolor developing apparatus 10 in accordance with the present invention. The color copier, generally 170, includes a lamp 172 for illuminating a document, not shown, laid on a glass platen 174, a first mirror 176, a second mirror 178, a third mirror 180, a lens 182, a fourth mirror 184, and a filter assembly 186. The color copier 170 further includes a latent image forming device which consists of a photoconductive drum 20, a pre-cleaning discharger 188, a discharging lamp 190, and a charger 192; a transfer device consisting of a transfer drum 194; a clamper 196; a transfer charger 198 for transferring a toner image to a paper; and separting chargers 200 and 202 for separating the paper from the transfer drum 194; and a fixing device 204 for fixing the toner image on the paper, paper feed devices 206 and 208, etc.

The rotary multicolor developing unit 10 with the developing units 28*a* to 28*d* is installed in the color copier 170. As already stated, the developing units 28*a* to 28*d* correspond to a black, a cyan, a yellow, and a magenta developing unit, respectively. Specifically, the developing unit 28*d* positioned next to the black developing unit 28*a* is a magenta developing unit which is of frequent use, and the developing unit 28*b* on the side opposite to the developing unit 28*d* is a cyan developing unit. In short, the black developing unit 28*a*, magenta developing unit 28*d*, yellow developing unit 28*c*, and cyan developing unit 28*b* are arranged in this order as seen in the counter-clockwise direction.

The image recording process will be described on a mode basis with reference made to FIG. 10.

(1) Color Mode

When a print switch, not shown, is turned on, the photoconductive drum 20 begins to rotate, and so do the feed rollers 210*a* and 210*b* to feed a paper toward a resist roller 212. After the paper has been stopped by the resist roller 212, it is driven by the same roller 212 until its leading end becomes clamped by the clamper 196 and wound around the transfer drum 194. On the other hand, the lamp 172 is moved to scan a document which is laid on the glass platen 174. Light reflected by the document is focused on the photoconductive drum 20 by way of the first mirror 176, second mirror 178, third mirror 180, lens 182, fourth mirror 184, and a green filter 186 G of the filter assembly 186.

The photoconductive drum 20 which has been uniformly charged by the charger 192 is exposed imagewise by the above procedure, so that a latent image is formed electrostatically on the drum 20. This latent image is developed by the magneta toner which is deposited on the sleeve 30*d* of the magenta developing unit 28*d*. Then, a pre-transfer discharging lamp 214 is energized to illuminate the drum 20 from above the toner image to thereby discharge the drum surface, and the transfer charger 198 is energized to transfer the magenta toner image to the paper which is wound around the transfer drum 194. By such a procedure, a red image component is reproduced on the paper.

At this stage of operation, the paper is held wound around the transfer drum 194 by the clamper 196 and the electrostatic force which is exerted by the transfer charger 198. After the image transfer, the charge remaining on the surface of the photoconductive drum 20 is removed by the pre-cleaning discharger 188 while at the same time the residual toner is removed by a cleaning unit 216. Further, the surface potential of the drum 20 is lowered to zero volt by the discharging lamp 190 over the whole surface of the drum 20.

Next, the lamp 172 which has been returned to its home position begins another stroke and, at the same time, the developing drum 12 of the apparatus 10 is rotated clockwise by 90 degrees to locate the sleeve 30*c* at a prescribed developing position 218. Image light reflected by the document is focused on the photoconductive drum 20 by way of the same mirror and lens arrangement and, this time, a blue filter 186BL of the filter assembly 186. The surface of the drum 20 having been discharged by the lamp 190 during the previous step is uniformly charged by the charger 192 and, then, exposed imagewise to the reflection from the document as previously stated. The resultant latent image provided on the drum 20 is developed by the yellow toner which is carried on the sleeve 30*c*. Thereupon, the surface of the drum 20 is illuminated by the pre-transfer discharging lamp 214 from above the toner image and thereby discharged. The yellow toner image is transferred by the transfer charger 198 to the paper which is still loaded on the transfer drum 194.

By the sequence of steps described so far, the yellow toner image is reproduced from above the magenta toner image on the paper. The paper is still retained on the transfer drum 194.

After the transfer of the yellow toner image, the surface of the photoconductive drum 20 is discharged by the pre-cleaning discharger 188 while at the same time the residual toner is removed by the cleaning unit 216. Further the surface potential of the drum 20 is lowered to zero volt by the discharge lamp 190 over the entire surface of the drum 20.

In the above condition, the lamp 172 begins another stroke while at the same time the developing drum 12 is rotated clockwise by another 90 degrees to bring the sleeve 30*b* to the developing position 218. Again, the image light from the document is focused on the photoconductive drum 20 via the mirror and lens system and, this time, a red filter 186R of the filter assembly 186. The resultant latent image on the drum 20 is developed by the cyan toner which is deposited on the sleeve 30*b*, the cyan toner image being then transferred to the paper on the transfer drum 194.

As a consequence, the magenta toner image, yellow toner image and cyan toner image are provided on the paper in a superposed configuration.

Subsequently, the separating chargers 200 and 202 are energized to cancel the electrostatic force acting on the paper. When the leading end of the paper has moved past the chargers 200 and 202, the clamper 196 is opened so that the leading end of the paper run onto a separator pawl 220, resulting that the paper is bodily separated from the transfer drum 194. The paper is transported by a belt 222 to the fixing device therefrom, to the outside of the machine. In the meantime, the charge remaining on the surface of the photoconductive drum 20 is removed by the pre-cleaning discharger 188 while at the same time the residual toner is removed by the cleaning unit 216. Further, the surface potential of the drum 20 is lowered to zero volt by the discharge lamp 190 over the entire area of the drum 20.

(2) Black-And-White Mode

When an input key assigned to a black-and-white document, not shown, is turned on, the developing drum 12 is rotated until the sleeve 30*a* of the black developing unit 28*a* becomes located at the developing position 218. As the print key switch is turned on, the photoconductive drum 20 begins to rotate while at the same time the feed rollers 210*a* and 210*b* also start to rotate to feed a paper toward the resist roller 212. The paper is once stopped at the position of the resist roller 212 and, then, driven by the roller 212 to be clamped 196 and thereby wound around the transfer drum 194. On the other hand, image light reflected by a document on the glass platen 174 is transmitted through the mirror and lens arrangement and, this time, an ND filter 186N of the filter assembly 186 to reach the photoconductive drum 20. The resultant latent image provided on the drum 20 is developed by the black toner which is carried on the sleeve 30*a*. Subsequently, the pre-transfer discharging lamp 214 is energized to illuminate the drum 20 from above the black toner image to discharge the surface of the drum 20. Then, the transfer charger 198 is energized to transfer the black toner image from the drum 20 to the paper which is wound around the transfer drum 194.

Thereupon, the separating chargers 200 and 202 are actuated to cancel the electrostatic force acting on the paper. When the leading end of the paper has moved past the chargers 200 and 202, the clamper 196 is opened so that the leading end of the paper runs onto the separator pawl 220. After the paper has been separated from the transfer drum 194 by such a step, it is transported by the belt 222 to be driven to the outside of the machine by way of the fixing device 204. In the meantime, the charge remaining on the photoconductive drum 20 is removed by the pre-cleaning discharger 188 while at the same time, the residual toner is removed by the cleaning unit 216. Further, the surface potential of the drum 20 is reduced to zero volt by the discharge lamp 190 over the entire surface of the drum 20.

(3) Black-And-Magenta (Red) Mode

This mode is usable to record black characters and magenta characters together in a single transfer paper. In this mode, a document with black characters (hereinafter referred to as a black document) is placed on the glass platen 174 first. This is followed by the same procedure as has been described in relation to the Black-And-White mode. During this part of the operation, a paper remains wound around the transfer drum 194. Thereafter, the black document on the glass platen 174 is replaced with a document with red characters (hereinafter referred to as a red document). As the print switch is turned on again, the developing drum 12 is rotated clockwise by 90 degrees to bring the sleeve 30*d* to the developing position 218. Then, the paper provided with a black toner image and a red toner image by the previously stated steps is driven to the outside of the machine by way of the fixing device 204.

(4) Black-And-Cyan (Blue) Mode

The same process as in the Black-And-Magenta Mode is executed except that the developing drum 12 is rotated counterclockwise by 90 degrees to cause development in cyan to follow development in black. It is to be noted that a senor or a switch is associated with each of the developing units to allow an operator to see a particular color in which the development is proceeding, on a control panel or like display.

Figure 11:
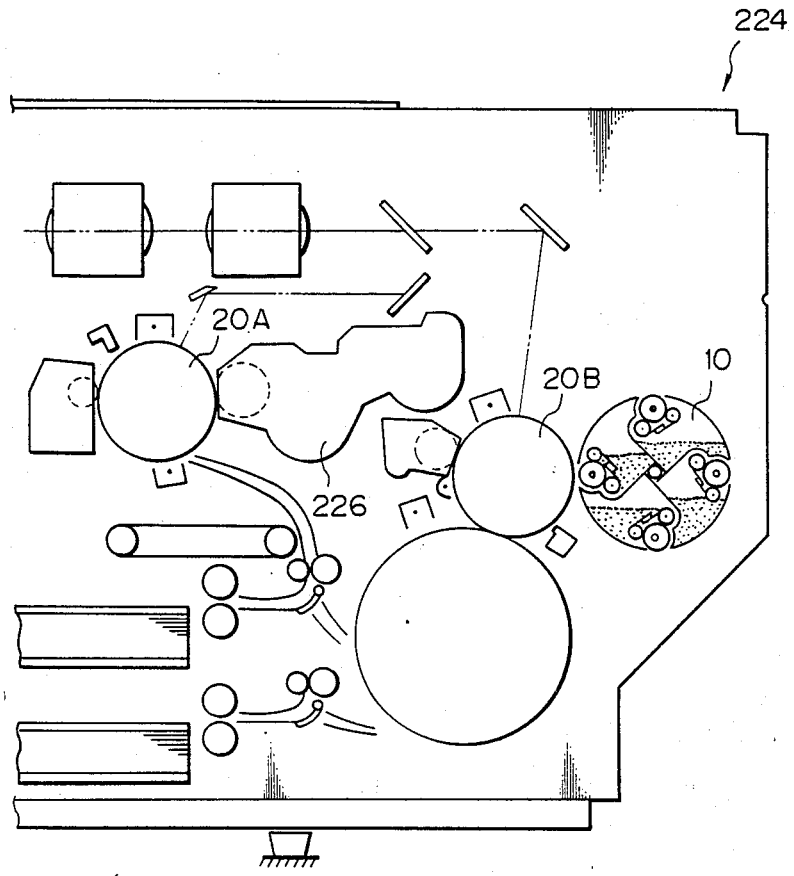

Referring to FIG. 11, an electrophotographic copier capable of selectively performing full-color copying and black-and-white copying is shown and generally designated by the reference numeral 224. As shown, the copier 224 is provided with a photoconductive drum 20A exclusive for black-and-white recording, and a photoconductive drum 20B exclusive for color recording. A developing apparatus 226 exclusive for black-and-white recording is disposed in the vicinity of the drum 20A while the rotary multicolor developing apparatus 10, for example, is disposed in the vicinity of the developing drum 20B. The black-and-white developing apparatus 226 may be implemented with a conventional two-component developing apparatus.

As described above, a rotary developing apparatus in accordance with the present invention includes a plurality of developing units each being constituted by a magnetic brush, and means for supplying toner to and collecting toner from the magnetic brush. This makes it needless for a two-component developer to be agitated in each of the developing units and, thereby, omits various kinds of agitating mechanisims while saving spaces otherwise occupied by those mechanisms, whereby each developing unit of a rotary developing apparatus is considerably miniaturized. Hence, a multicolor developing apparatus of the kind using a two-component developer can be handled as easily as a one of the kind using a one-component developer. The omission of agitating mechanisms slows down the fatigue of a carrier while at the same time the stability of images and the flexibility particular to a two-component developing system are preserved.

In a developing apparatus of the present invention, a drive connect/disconnect device is installed in a drive system of a machine body so that, while the apparatus is out of operation, a drive output portion of the drive system may be maintained in a free state. Such allows the drive output portion of the drive system to be coupled with a drive input portion of any of developing units under smooth synchronization. It follows that any of the developing units can be located at a prescribed developing position with its drive input portion connected very smoothly to the drive output portion, eliminating damage to various parts as well as noise and, thereby, enhancing the reliability of the developing apparatus.

A rotary developing apparatus of the present invention includes positioning means for positioning a rotatable body such that the apparatus is located in a prescribed developing position. The positioning means, therefore, insures an adequate gap for development to thereby provide quality images stably.

Furthermore, a rotary multicolor developing apparatus of the present invention includes sealing members which are provided on both end portions of a developing drum to stop the outflow of toner. Hence, toner is prevented from being leaked and scattered around, whereby the image quality is stabilized and the reliability of the apparatus is enhanced.

Yet another advantage of the present invention is that toner can be supplied without being mixed with another toner of different color or being scattered around.

In addition, a developing apparatus of the present invention which is applicable to a color electrophotographic device achieves developing conditions optimum for both full-color development and monocolor development without resorting to complicated operations and structural changes.

Various modifications will become possible for those skilled in the art after receiving the teachings of the present disclosure without departing from the scope thereof.

What is claimed is:

1. A rotary multicolor developing apparatus comprising:

(a) a latent image carrier;

(b) a rotatable developing drum with developing units which is disposed near to and facing said latent image carrier for carrying an electrostatic latent image therewith, said rotatable developing drum being indexed about a shaft thereof by predetermined angles so that, during use of said apparatus, the latent image is developed in a predetermined developing region by toner of different colors which are fed from said developing units of said rotatable developing drum, said developing units each comprising:

(i) developing brush means for forming a magnetic brush which is sequentially transported between a toner supply region, said developing region, and a toner recovery region and which, in said developing region, makes contact with the latent image;

(ii) toner supply means for conveying the toner which is charged in said toner supply region to the magnetic brush of said developing brush means; and (iii) toner recovery means for recovering in said toner recovery region the toner which is remaining on the magnetic brush after development;

(c) imperforate first partition members disposed in said developing drum to define developing chambers which, during use of said apparatus, each store toner of a respective one of said colors;

(d) a toner supply drum for storing supplementary toner of different colors, said toner supply drum being mounted on a shaft and rotatable with said shaft, said shaft being coaxial with said shaft of said developing drum;

(e) imperforate second partition members disposed in said toner supply drum to define toner chambers each storing, during use of said apparatus, supplementary toner of a respective one of said different colors;

wherein:

(f) each of said developing chambers extends radially from said shaft of said developing drum;

(g) each of said developing units is disposed in a corresponding one of said developing chambers for developing the latent image with the toner;

(h) each of said toner chambers extends radially from said shaft of said toner supply drum; and (i) said developing apparatus further comprises a plurality of toner conveyor means, each one of said plurality of toner conveyor means connecting one of said toner chambers to a corresponding one of said developing chambers to convey a supplementary amount of toner from said one of said toner chambers to said corresponding one of said developing chambers, each one of said plurality of toner conveyor means extending from a point in the corresponding one of said toner chambers located radially outwardly from said shaft of said toner supply drum in parallel to said shaft of said toner supply drum to a corresponding point in the corresponding one of said developing chambers located radially outwardly from said shaft of said developing drum.

2. An apparatus as claimed in claim 1, wherein each of said developing brush means comprises:

(a) a rotatable cylindrical sleeve which is made of a nonmagnetic material and (b) a magnet rotatably received in said rotatable cylindrical sleeve to form the corresponding magnetic brush on said rotatable cylindrical sleeve.

3. An apparatus as claimed in claim 2, wherein, in each of said developing units, during use of said apparatus, the corresponding magnetic brush is transported in a rotational motion and in a predetermined direction by rotation of at least one of said rotatable cylindrical sleeve and said magnet.

4. An apparatus as claimed in claim 1, wherein each of said toner supply means comprises a rotatable toner supply roller which, during use of said apparatus, is held in contact with the corresponding magnetic brush.

5. An apparatus as claimed in claim 4, wherein each of said rotatable toner supply rollers is positioned such that, during use of said apparatus, fibers of the corresponding magnetic brush are regulated to a predetermined height.

6. An apparatus as claimed in claim 4, wherein each of said toner supply means further comprises a toner layer limiting blade which, during use of said apparatus, is pressed against said toner supply roller to triboelectrically charge the toner retained on said toner supply roller while shaping the toner into a uniform thin layer.

7. An apparatus as claimed in claim 1, wherein each of said toner recovery means comprises a toner recovery roller which, during use of said apparatus, is held in contact with the corresponding magnetic brush.

8. An apparatus as claimed in claim 7, wherein each of said toner recovery means further comprises a toner scraper blade pressed against said toner recovery roller for scraping toner particles off said toner recovery roller.

9. An apparatus as claimed in claim 1, wherein:

(a) during use of said apparatus, one of said developing units stores black toner and (b) said one of said developing units is located next to another of said developing units which, during use of said apparatus, stores magenta toner.

10. An apparatus as claimed in claim 1, wherein said developing apparatus further comprises drive transmission control means for transmitting a drive force to any one of said developing unit when said developing unit is positioned in said developing region, and for not transmitting said drive force when said developing unit is out of said developing region, thereby maintaining said developing unit in a free state.

11. An apparatus as claimed in claim 1, wherein said developing apparatus further comprises a cylindrical housing which supports said rotatable developing drum rotatably.

12. An apparatus as claimed in claim 11, wherein said cylindrical housing is formed with a rectangular window which faces said latent image carrier.

13. An apparatus as claimed in claim 1, wherein said developing apparatus further comprises an agitator accommodated in each one of said toner chambers for agitating the toner.

14. An apparatus as claimed in claim 1, wherein each of said toner conveyor means comprises:

(a) a screw conveyor connecting said toner chamber and said developing chamber to supply the toner and (b) a cylindrical conveyor case surrounding said screw conveyor while allowing said screw conveyor to rotate therein.

15. An apparatus as claimed in claim 14, wherein each of said conveyor cases is provided with a slot adjacent to the corresponding developing chamber, the toner being dropped through said slot.

16. An apparatus as claimed in claim 1, wherein each of said developing chambers has the same circumferential dimension as the others and extends along said shaft of said developing drum.

17. An apparatus as claimed in claim 1, wherein each of said toner chambers has the same circumferential dimension as the others and extends along said shaft of said toner supply drum.

* * * * *